US006303548B2

(12) United States Patent
Gao

(10) Patent No.: US 6,303,548 B2
(45) **Date of Patent: *Oct. 16, 2001**

(54) PARTLY SYNTHETIC MULTIGRADE CRANKCASE LUBRICANT

(75) Inventor: Jason Z. Gao, Sarnia (CA)

(73) Assignee: Exxon Research and Engineering Company, Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/268,449

(22) Filed: Mar. 12, 1999

Related U.S. Application Data

(63) Continuation-in-part of application No. 09/209,220, filed on Dec. 11, 1998, now abandoned.

(51) Int. Cl.[7] ..... C10M 129/68; C10M 145/22
(52) U.S. Cl. ..... 508/469; 508/463; 585/10
(58) Field of Search ..... 585/10; 508/469, 508/463

(56) References Cited

U.S. PATENT DOCUMENTS

| | | | | |
|---|---|---|---|---|
| 3,838,049 | | 9/1974 | Souillard et al. | 252/32.7 |
| 4,402,841 | | 9/1983 | Schieman | 252/46.6 |
| 4,853,139 | | 8/1989 | Ichihashi | 252/32.7 |
| 4,956,122 | | 9/1990 | Watts et al. | 252/565 |
| 5,108,635 | | 4/1992 | Gabillet et al. | 252/56 R |
| 5,558,802 | | 9/1996 | Dowling | 508/391 |
| 5,595,966 | | 1/1997 | Rees et al. | 508/591 |
| 5,858,932 | * | 1/1999 | Dasai | 508/371 |

FOREIGN PATENT DOCUMENTS

| | | | | |
|---|---|---|---|---|
| 0281060B1 | | 6/1993 | (EP) | C10M/169/04 |
| 0452998B1 | | 6/1994 | (EP) | C10M/169/04 |
| 0767236 | * | 4/1997 | (EP) . | |
| 1162172 | | 8/1969 | (GB) . | |
| 2267098 | | 11/1993 | (GB) | C10M/169/04 |

* cited by examiner

*Primary Examiner*—Margaret Medley
*Assistant Examiner*—Cephia D. Toomer
(74) *Attorney, Agent, or Firm*—Joseph J. Allocca

(57) ABSTRACT

A base oil for an SAE 0W-40 lubricant composition comprises a mineral basestock, a polyalpha olefin and synthetic ester lubricant. The SAE 0W-40 lubricant comprises the base oil and a mixture of polymethacylate and olefin copolymer or hydrogenated diene VI improvers.

3 Claims, No Drawings

PARTLY SYNTHETIC MULTIGRADE CRANKCASE LUBRICANT

CROSS REFERENCE TO RELATED APPLICATION

This application is a Continuation-in-Part of application Ser. No. 09/209,220 filed Dec. 11, 1998 now abandoned.

FIELD OF THE INVENTION

The present invention relates to a multigrade crankcase lubricants that have good low and high temperature properties. More particularly the present invention relates to an SAE 0W-40 lubricant that contains both a conventional mineral basestock and a nonconventional or synthetic lubricant.

BACKGROUND OF THE INVENTION

Crankcase lubricating oils must provide minimal frictional wear in an engine over a wide range of operating temperatures. These engine temperatures can range from below freezing during cold weather starting to above 400° F. (200° C.) during severe usage. Lubricants which meet SAE viscosity specifications for both low and high temperatures are known as multigrade oils.

Blending basestocks of different viscosities is one way of formulating a multigrade oil. Merely blending basestocks of different viscosities, however, may not enable the formulators to meet the low and high temperature viscosity requirements of some multigrade oils let alone other properties such as volatility and seal compatibility. The formulator's primary tool for meeting multigrade oil viscosity requirements is an additive referred to as a viscosity modifier.

An alternative means of reducing the basestock viscosity is to employ so-called non-conventional lubricants (or NCL). Examples of NCLs are synthetic basestocks such as polyalphaolefin oligomers (PAO) and diesters and specially processed mineral basestocks such as basestocks that have been hydro-cracked or hydroisomerised to give greater paraffinic content and lower aromatic content. These NCLs, especially the diesters, are very expensive, may not respond well to conventional antioxidant systems, and may not be fully compatible with standard sealant materials.

Accordingly, it is an object of the present invention to provide an 0W-40 motor oil that has desirable low and high temperature properties.

It is another object to provide a motor oil that is a blend of conventional and non-conventional lubricants.

These and other objects will become apparent upon reading the description which follows.

SUMMARY OF THE INVENTION

A base oil for an SAE 0W-40 lubricant is provided comprising a mixture of mineral basestock, a polyalpha olefin and a synthetic ester lubricant. The SAE 0W-40 lubricant includes a viscosity improver, especially a mixture of VI improvers. Optionally, the lubricant includes antioxidant additives.

Engine lubricants containing the base oil of the present invention are capable of improving the fuel efficiency of an engine under conditions of use.

DETAILED DESCRIPTION OF THE INVENTION

1. THE BASE OIL

A. Mineral Basestock

The basestock used in the base oil may be selected from any of the natural mineral oils of API Groups I, II, III, IV or mixtures of these used in crankcase lubricating oils for spark-ignited and compression-ignited engines. Preferably, the mineral basestock is a Group II or III basestock having the properties shown in Table 1.

TABLE 1

| KV @ 40° C. cSt | KV @ 100° C. cSt | KV @ 100° F. SUS | VI | Pour Point, ° C. | Saturates, wt % | Sulfur, wt % | Flash COC, ° C. |
|---|---|---|---|---|---|---|---|
| 13.0–23.0 | 3.5–5.0 | 70–125 | 90–150 | <–12 | >75 | <0.1 | >170 |

B. The Polyalpha Olefin

The polyalpha olefin (PAO) used in the base oil may be selected from any of the olefin oligomer oils used in lubricants. In general the PAO will have a viscosity at 100° C. in the range of about 3.5 to about 4.5 cSt and preferably about 3.7 to about 4.2 cSt. Preferably the polyalpha olefin is one having the properties shown in Table 2.

TABLE 2

| KV @ 40° C. cSt | KV @ 100° C. cSt | KV @ 100° F. SUS | VI | Pour Point, ° C. | Saturates, wt % | Sulfur, wt % | Flash COC, ° C. |
|---|---|---|---|---|---|---|---|
| 16.0–18.0 | 3.7–4.2 | 85–100 | 115–135 | <–60 | >99.9 | <0.01 | >204 |

C. The Ester

Useful synthetic esters include the esters of monocarboxylic and poly-carboxylic acids with monohydroxy alcohols and polyols. Typical examples include didodecyl adipate, diisodecyl adipate, pentaerythritol tetracaproate, and dilauryl sebacate. In general, the ester used will have a viscosity at 100° C. in the range of about 2 to about 4 cSt and preferably about 2.5 to about 3.5. Preferred properties for the ester are given in Table 3.

TABLE 3

| KV @ 40° C. cSt | KV @ 100° C. cSt | VI | Pour Point, ° C. | Flash COC, ° C. |
|---|---|---|---|---|
| 8.5–14.0 | 2.5–3.5 | 110–160 | <−60 | >190 |

D. The Proportions

The base oil typically comprises from about 5 to 80 vol % of the mineral basestock, from about 5 to 90 vol % of the polyalpha olefin and from about 1 to 30 vol % of the ester. Preferably, the base oil comprises 20 to 50 vol % of the basestock, 30 to 75 vol % polyalpha olefin and 3 to 20 vol % esters. In a particularly preferred embodiment the base oil comprises from about 25 to 45 vol % of the mineral base stock, from about 40 to 70 vol % of the polyalpha olefin and from about 3 to 20 vol % esters.

2. VI IMPROVERS

An SAE 0W-40 lubricant of the invention comprises the above base oil and VI improvers. VI improvers are components of lubricants which serve to decrease the viscosity changes in a lubricant with changes in temperature. Many different polymers are known to function as VI improvers. See for example, Smalheer, et al., *Lubricant Additives*, The Lezium-Hiles Company (1967), pages 8 and 9.

Of the many compounds known to be useful as VI improvers, alkyl methacrylate copolymers (PMA's) are recognized as having especially beneficial VI improver properties. Within this class, interpolymers of a short chain alkyl methacrylate, a long chain alkyl methacrylate and N,N-dialkylaminoalkyl methacrylate and/or methacrylamide (the alkyls of the dialkylaminoalkyl moiety having 1 to 6 carbon atoms) are particularly beneficial.

Typically VI improvers are formed in a hydrocarbon solvent and it is in this form that they are blended in the base oil.

Another group of VI improvers are olefin copolymers (OCP's) such as copolymers of ethylene and propylene.

These too typically are prepared in a solvent and are blended, in this form, in the base oil.

A third group of VI improver is hydrogenated diene copolymers which include styrene-hydrogenated diene block copolymers and hydrogenated star-branched polyisoprene. These polymers are made by an anionic polymerization process. They are typically available as a blend with a basestock and are added to the base oil as a blend.

The viscosity modifier used in the invention will be used in an amount to give the required viscosity characteristics. Since viscosity modifiers are often added to blends in the form of oil solutions the amount of additive employed will depend on the concentration of polymer in the oil solution comprising the additive. However, by way of illustration, typical oil solutions of polymer used as viscosity modifiers are used in amount of from 1 to 30% of the blended oil. The amount of viscosity modifier as active ingredient of the oil is generally from 0.01 to 6 wt %, and more preferably from 0.1 to 4 wt %.

In the present invention it is preferred to use both a PMA and a OCP or hydrogenated diene VI improver in amounts ranging from about 3.0 to 7.0 vol % for the PMA VI improver and from about 4.0 to about 9.0 vol % for the OCP or hydrogenated diene VI improver.

3. DDI

The motor oil of the present invention has multifunctional additives of the type found in modem oil formulations. These additives are usually not added independently, but are precombined in DDI (detergent-dispersant-inhibitor) packages which can be obtained commercially from suppliers of lube oil additives. DDI packages with a variety of ingredients, proportions and characteristics are available.

4. ANTIOXIDANTS

Optionally, the motor oil may contain minor but effective amounts of antioxidants such as those used in contemporary motor oil formulations. A particularly preferred antioxidant comprises a mixture of alkylated diphenyl amine and hindered phenols.

EXAMPLES

The invention will now be described by way of illustration only with reference to the following examples. In the examples, unless otherwise noted, all treat rates of all additives are reported as volume percent.

Examples 1, 2, and Comparative Examples A, B, C

Experimental SAE 0W-40 lubricants were made having the compositions given in Table 4. The Table also gives the acceptable property limits or targets and the actual measured properties for each formulation.

TABLE 4

| COMPONENTS | | EXAMPLES 1 | EXAMPLES 2 | COMPARATIVE EXAMPLES A | COMPARATIVE EXAMPLES B | COMPARATIVE EXAMPLES C |
|---|---|---|---|---|---|---|
| | Group II Basestock | 26.76% | 29.63% | 29.38 vol % | 26.34 vol % | 28.76 vol % |
| Durasyn 164[1] | PAO 4 | 36.00 vol % | 30.09 vol % | 33.00 vol % | 36.84 vol % | 34.00 vol % |
| Vistone A-10[2] | Ester | 10.0 vol % | 16.56 vol % | 15.00 vol % | 11.00 vol % | 10.00 vol % |
| Oloa 9061E[3] | DI Package | 13.44 vol % | — | — | — | 13.44 vol % |
| Oloa 9015M[3] | DI Package | — | 12.52% | 12.52 vol % | 12.52 vol % | — |
| Paratone 8024[4] | OCP VI Improver | 8.00 vol % | — | — | 7.30 vol % | 8.00 vol % |
| Acryloid 953M[5] | PMA VI Improver | 5.80 vol % | — | — | — | 5.80 vol % |
| Acryloid 954[5] | PMA VI Improver | — | 6.00 vol. | 10.10 vol % | 6.00 vol % | — |
| Shellvis 200C[6] | Star Copolymer VI Improver | — | 5.20 vol % | — | — | — |
| | TARGETS | | | | | |
| KV @ 100° C. cSt | 12.5–16.3 | 15.61 | 15.78 | 15.80 | 15.47 | 15.71 |
| CCS @ −30° C., cP | <2900 | 2810 | 2870 | 2950 | 2860 | 2870 |
| Shear Stability, Viscosity After ASTM D3945 | >12.5 cSt | 12.51 | 12.98 | 11.66 | 12.43 | |
| TBS Viscosity, cP | >3.7 | 4.03 | 4.24 | 4.10 | 4.11 | |

TABLE 4-continued

| COMPONENTS | | EXAMPLES 1 | EXAMPLES 2 | COMPARATIVE EXAMPLES A | COMPARATIVE EXAMPLES B | COMPARATIVE EXAMPLES C |
|---|---|---|---|---|---|---|
| MRV @ −40° C. cP | <20,000 | 16,600 | 18,500 | 14,500 | | |
| Pour Point, ° C. | ≦−51 | −51 | −54 | −54 | −51 | |
| Noack Volatility | <18% | 17.8% | | | | |
| Comments: | | | | Not meeting shear stability | Not meeting shear stability | High Noack volatility |

[1]Durasyn 164 is a mixture of 1-decene oligomers sold by Amoco Chemicals, Endwell, New York.
[2]Vistone A-10 is an octyl adipate ester sold by Exxon Chemical Co., Houston, Texas.
[3]Oloa 9061E and 9015 M are DDI packages sold by Oronite, Richmond, California.
[4]Paratone 8024 is a semicrystalline copolymer in 100N oil sold by Exxon Chemicals, Linden, New Jersey.
[5]Acryloid 954 are PMA's sold by Romax Additives Gmbh, Philadelphia, Pennsylvania.
[6]Shellvis 200C is a hydrogenated, star-branched polyisoprene sold by Shell Chemical Company, Houston, Texas.

As shown in the above table, the right balance of the OCP and PMA VI improvers as well as the base oil components lead to formulations with excellent performance characteristics. Comparative formulations A, B, and C fail to meet the targets in one or more aspects. The formulation for Example 2, while meeting most of the performance targets, is less desirable because of the amount of synthetic ester. Indeed, oil formulations of this invention preferably contain less than 12 vol % of a synthetic ester lubricant.

Example 3

The fuel consumption of a Detroit Diesel series 60 engine was measured over a range of driving conditions using the 0W-40 lubricant of Example 1. The results were compared with operating the same engine over the same driving conditions but using commercially available 15W40 oil. The percent increase in fuel efficiency is shown in Table V.

TABLE V

| | City Stop & Go | Level Highway | Rolling Highway | Highway Mountains |
|---|---|---|---|---|
| Fuel Efficiency Benefit | 2.2% | 1.06% | 0.89% | 0.63% |

What is claimed is:

1. An SAE 0W40 lubricant consisting essentially of:

a base oil of from about 5 to 80 vol % of a mineral basestock having a viscosity at 100° C. in the range of about 3.5 to 5.0 cSt, from about 5 to 90 vol % of a polyalpha olefin lubricant having a viscosity at 100° C. in the range of about 3.5 to 4.5 cSt and from about 1 to about 30 vol % of an ester lubricant having a viscosity at 100° C. in the range of about 2 to about 4 cSt; and a mixture of polymethacrylate and olefin copolymer or hydrogenated diene copolymer VI improvers wherein the polymethylmethacrylate VI improver is present in an amount ranging from about 3 to about 7 vol % and the olefin or hydrogenated drive copolymer is present in an amount ranging from about 4 to about 9 vol %; and a detergent-dispersant inhibitor package.

2. The lubricant of claim 1 wherein the base oil consists of 20 to 50 vol % mineral basestock, 30 to 75 vol % polyalpha olefin and 3 to 20 vol % ester.

3. A method for improving the fuel efficiency of an engine having a crankcase lubricant by using as lubricant, a lubricant comprising:

a base oil consisting essentially of from about 25 to 45 vol % of a mineral base stock, from about 40 to 70 vol % of a polyalpha olefin lubricant having a viscosity at 100° C. in the range of about 3.5 to about 4.5 cSt, from about 3 to 20 vol % of an ester having a viscosity at 100° C. in the range of about 2 to about 4 cSt; and a mixture of polymethacrylate and olefin copolymer or hydrogenated diene copolymer VI improvers wherein the polymethacrylate VI improver is present in an amount ranging from about 3 to about 7 vol % and the olefin copolymer or hydrogenated diene copolymer is present in an amount ranging from about 4 to about 9 vol %.

* * * * *

UNITED STATES PATENT AND TRADEMARK OFFICE

CERTIFICATE OF CORRECTION

PATENT NO. : 6,303,548 B2
DATED : October 16, 2001
INVENTOR(S) : Jason Z. Gao

It is certified that error appears in the above-identified patent and that said Letters Patent is hereby corrected as shown below:

Claim 1,
Line 11, change "polymethylmethacrylate" to -- polymethacrylate --.
Line 13, change "drive" to -- diene --.

Claim 3,
Line 2, please delete "as lubricant,".

Signed and Sealed this

Twenty-sixth Day of March, 2002

*Attest:*

*Attesting Officer*

JAMES E. ROGAN
*Director of the United States Patent and Trademark Office*